US008424702B2

(12) United States Patent
Cassina

(10) Patent No.: US 8,424,702 B2
(45) Date of Patent: Apr. 23, 2013

(54) PALLET CONTAINER FOR LIQUIDS

(75) Inventor: Virginio Cassina, Gorle (IT)

(73) Assignee: Daviplast-Servicos de Consultoria Sociedade Unipessoal Lda., Funchal Madeira (PT)

( * ) Notice: Subject to any disclaimer, the term of this patent is extended or adjusted under 35 U.S.C. 154(b) by 200 days.

(21) Appl. No.: 12/862,016

(22) Filed: Aug. 24, 2010

(65) Prior Publication Data

US 2011/0073510 A1 Mar. 31, 2011

(30) Foreign Application Priority Data

Sep. 29, 2009 (EP) ..... 09398009

(51) Int. Cl.
*B65D 21/02* (2006.01)

(52) U.S. Cl.
USPC ..... 220/23.87; 220/23.91

(58) Field of Classification Search ..... 220/23.87, 220/23.9, 23.91, 485, 495.01
See application file for complete search history.

(56) References Cited

U.S. PATENT DOCUMENTS

| | | | | |
|---|---|---|---|---|
| 5,645,185 | A | 7/1997 | Cassina | |
| 2004/0195243 | A1 * | 10/2004 | Przytulla | 220/495.01 |
| 2005/0247710 | A1 | 11/2005 | Przytulla | |
| 2006/0288620 | A1 | 12/2006 | Weyrauch et al. | |

FOREIGN PATENT DOCUMENTS

EP 1 289 852 5/2006

OTHER PUBLICATIONS

EP Search Report for EP 09398009.2, dated Mar. 3, 2010.
Communication pursuant to Article 94(3) EPC, for EP 09398009.2, dated May 24, 2012.

* cited by examiner

*Primary Examiner* — Harry Grosso
(74) *Attorney, Agent, or Firm* — Nixon & Vanderhye PC

(57) ABSTRACT

The present invention relates to a pallet container for storage and transportation of liquids, comprising a liquid container (12), a cage (13) that encloses the container and a pallet (14) with said cage mounted thereto, the cage (13) comprising a plurality of vertical (19) and horizontal (18) tubular bars connected together by welded joints formed at respective intersections (20) between the bars. At least some of said bars (19) comprise indents (22), which are at a distance from said intersections (20) that is substantially equal to or longer than the width of the bars (19, 21).

14 Claims, 4 Drawing Sheets

PALLET CONTAINER FOR LIQUIDS

TECHNICAL FIELD

The present invention relates to a pallet container, of the type that is typically used for storage and transportation of liquids.

BACKGROUND OF THE INVENTION

It is known in the art to make liquid containers comprising a pallet, a protective cage mounted to the pallet, and a plastic container within the cage, for containing the liquid.

The cage is composed of a plurality of vertical and horizontal tubular metal bars, welded together at their intersections. The cage has the shape of a parallelepiped and a size that allows it to be fitted on the inner plastic container.

The most common capacity of these containers is about 1000 liters.

During transportation, the pallet container is subjected to mechanical stresses, for instance caused by road bumps or curves or the gap between rails of a railroad along which the container-carrying vehicle runs.

Particularly, as a liquid is being carried, it is subjected to movements and vibrations which cause cyclic and non-cyclic stresses on the side walls of the plastic container and hence on the walls of the cage.

In view of these stresses, the standards that govern carriage of dangerous goods (which is the main application of these containers) require manufacturers to perform a number of tests on the containers before introducing them into the market.

One of these tests requires the container supporting surface to be vibrated with a 25 mm oscillation amplitude and at such a frequency as to allow the passage of a 1.6 mm thick metal blade between the bottom of the container and the corresponding support surface. According to this standard the blade must be 50 mm wide and be able to be inserted between the pallet and the support surface through at least 100 mm. The container must be filled to not less than 98% of its maximum capacity.

According to the type of container, the testing frequency may be of the order of 150-230 rpm, e.g. about 180-190 rpm.

Under vibrational stresses as defined above, the pallet container was found to be sometimes damaged or broken at the welded joints between the orthogonal bars of the protective cage.

In an attempt to increase the resistance of the cage, and particularly to reduce the risk of failure at the welded joints between the bars, the prior art, in EP 1289852 suggested to form indents in the bars, directly adjacent to the welded joints, at a distance from the bar intersection equal to one tenth of the width of the bars.

This arrangement is aimed at forming higher flexibility points in the cage bars, to reduce stresses at the welded joints between the bars.

Thus, the cage structure so obtained is more flexible.

Furthermore, according to EP 1289852, the walls of the two opposing bars at the welded joints must be spaced to some extent, to allow quick drying of still water in the gaps, and prevent rust formation.

Still according to EP 1289852, the bars may have not more than 2 mm deep recesses in the welded joints. This restriction, when combined with the lack of contact between the bar walls, prevents achievement of the maximum achievable resistance at the welded joints.

Another pallet container is disclosed in U.S. Pat. No. 5,678,688, which addresses the problem of increasing the durability of the welded joints between the tubular bars of the outer cage that holds the plastic container therein. U.S. Pat. No. 5,678,688 suggests forming indents in the bars, directly adjacent to the intersections between the bars, to form bar bending points. Particularly, the indents are formed in a hollow area of the bar, where the welded joints are formed.

SUMMARY OF THE INVENTION

In view of the above prior art, the object of the present invention is to provide a pallet container that ensures satisfactory resistance to stresses in any condition, and particularly in the above described vibration tests.

A further object is to form a pallet container having increased rigidity.

According to the present invention, this object is fulfilled by a pallet container for storage and transportation of liquids, comprising an inner liquid container, a cage that encloses the inner container and a pallet with said cage mounted thereto, the cage comprising a plurality of vertical and horizontal tubular bars connected together by welded joints formed at respective intersections between the bars, at least some of these bars comprising one or more indents at a distance from said intersections, characterized in that said indents are at a distance from the intersections that is substantially equal to or longer than the width of the bars.

BRIEF DESCRIPTION OF THE DRAWINGS

The characteristics and advantages of the present invention will appear from the following detailed description of one practical embodiment, which is illustrated without limitation in the annexed drawings, in which.

DETAILED DESCRIPTION

Figure 1:
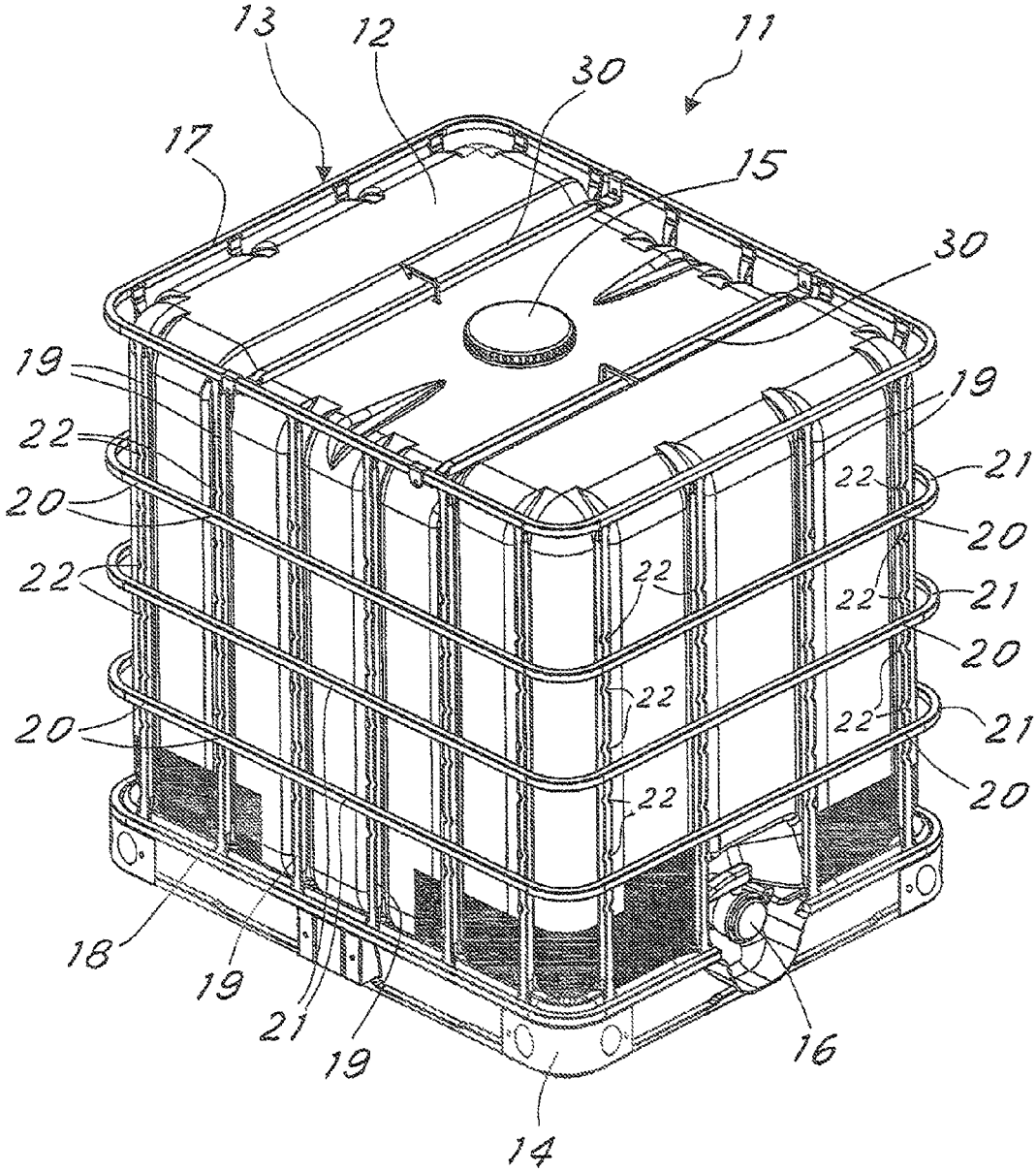
FIG. 1 is a perspective general view of a pallet container of the invention.

FIG. 1 shows a pallet container 11 comprising a pallet 14 with a cage 13 mounted thereto. A container 12 is placed in the cage 13 for containing the liquid to be stored or carried.

Like in prior art, the container is made of a plastic material. The cage 13 is fitted on the container 12 to provide protection and support to said container, particularly at the side walls thereof.

The pallet container 11 has the shape of a parallelepiped and may have a capacity, for example, of 1000 l.

The inner container 12 has a top filling opening, closed by a plug 15. At the bottom, the container 12 has a liquid discharge opening 16, which is formed as is known per se in the art.

The cage 13 has a plurality of horizontal and vertical tubular bars. The bars are formed of metal tubes, preferably of rectangular or square section. The bars of the cage intersect to form grid structures.

Particularly, the cage comprises the vertical bars 19, the horizontal bars 21 at an intermediate height, the top horizontal bar 17, the bottom horizontal bar 18, and at least two bars 30 for closing the cage at its top.

The horizontal bars 17, 18 and 21 have a substantially rectangular closed-loop shape and externally enclose the vertical bars 19.

The intermediate horizontal bars 21 are welded to the vertical bars 19 at the intersections 20, whereas the top bars 17 and 18 are connected to the ends of the vertical bars by a "spade type" connection.

The bottom bar 18 forms the bottom base of the cage and directly contacts the pallet 14. Horizontal bars 30 are fixed to the top bar 17 for closing the cage at the top.

There are preferably three intermediate horizontal bars 19 and four and six vertical bars 19 on the short and long sides of the cage 13 respectively.

Figure 2:
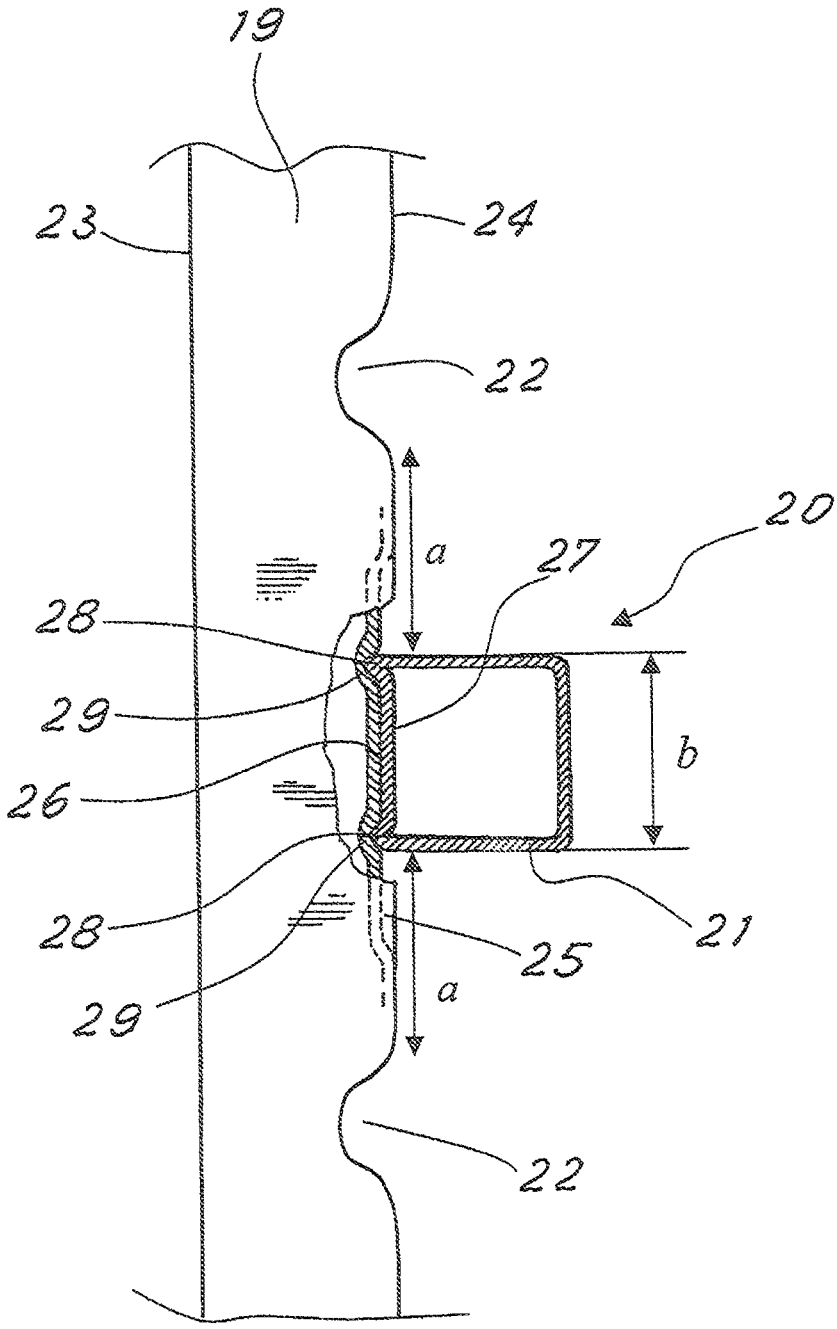
FIG. 2 is a partially cross sectional detail view of the intersection and welded area of two bars of the cage.

According to the invention, as clearly shown in FIG. 2, the bars of the cage 13 have indents 22 at a distance "a" from the intersections 20, which is substantially equal to or greater than the width "b" of the bars. The distance "a" is assumed to be calculated from the intersection 20 to the start of the indent 22, as shown in FIG. 2.

The above arrangement has been found to increase the stiffness of the side walls of the cage 13. Such increased stiffness can reduce the amplitude of pallet container wall vibration, thereby achieving the purpose of reducing the influence of the notch effect created by the welded joints during vibration tests.

Particularly, the positions of the indents 22 as taught by the invention impart stiffness to the structure under heavy loads.

As used herein the term "amplitude of wall vibration" is intended as the maximum displacement of the wall in a direction orthogonal to its extension.

Figure 3:
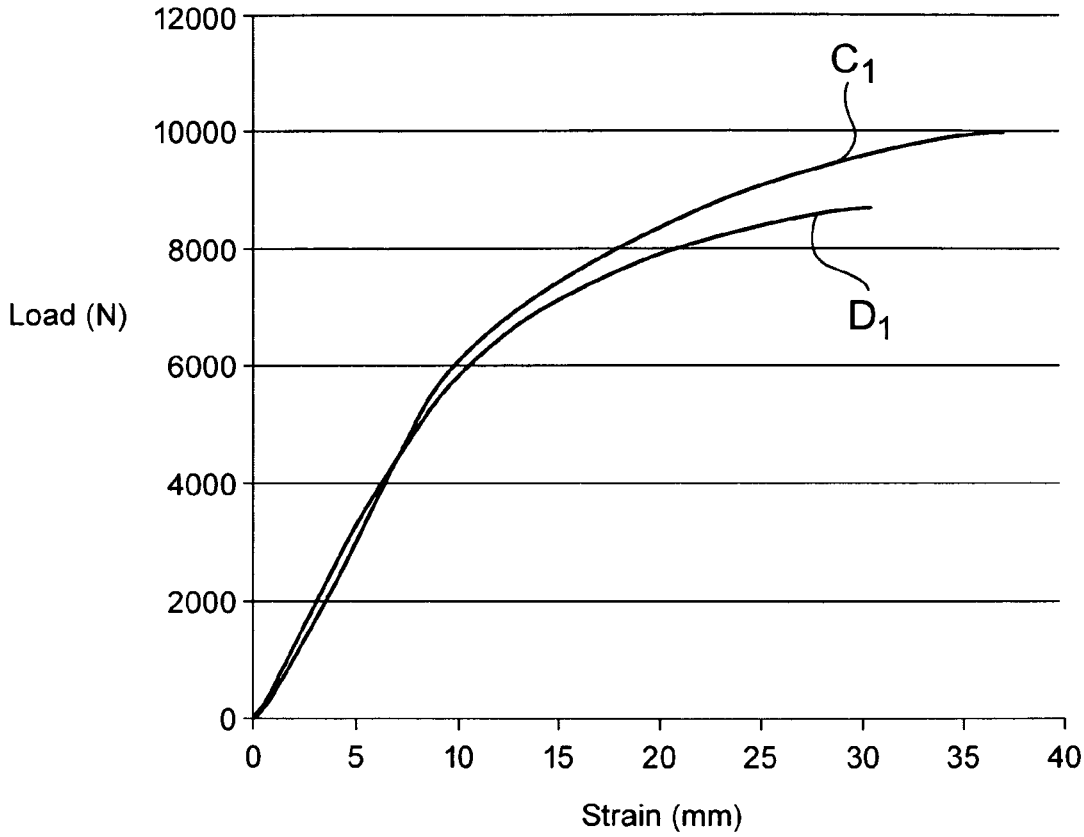
FIG. 3 is a diagram showing the stiffness of a cage wall having indents according to the invention and a cage wall with no indent.

In FIG. 3, the curve C1 is the load/strain curve obtained under a bending stress (i.e. the strain occurring during the test) of a cage wall having indents 22 according to the invention, whereas the curve D1 is the same curve for a cage wall with no indent. It may be appreciated that the indented cage 22 exhibits a higher stiffness under heavy loads. The loads, like the strains, are assumed to be directed orthogonal to the flat grid formed by a wall of the cage.

Such increased stiffness involves a higher resonance frequency of the cage structure, if the pallet container support surface is oscillated.

Figure 4:
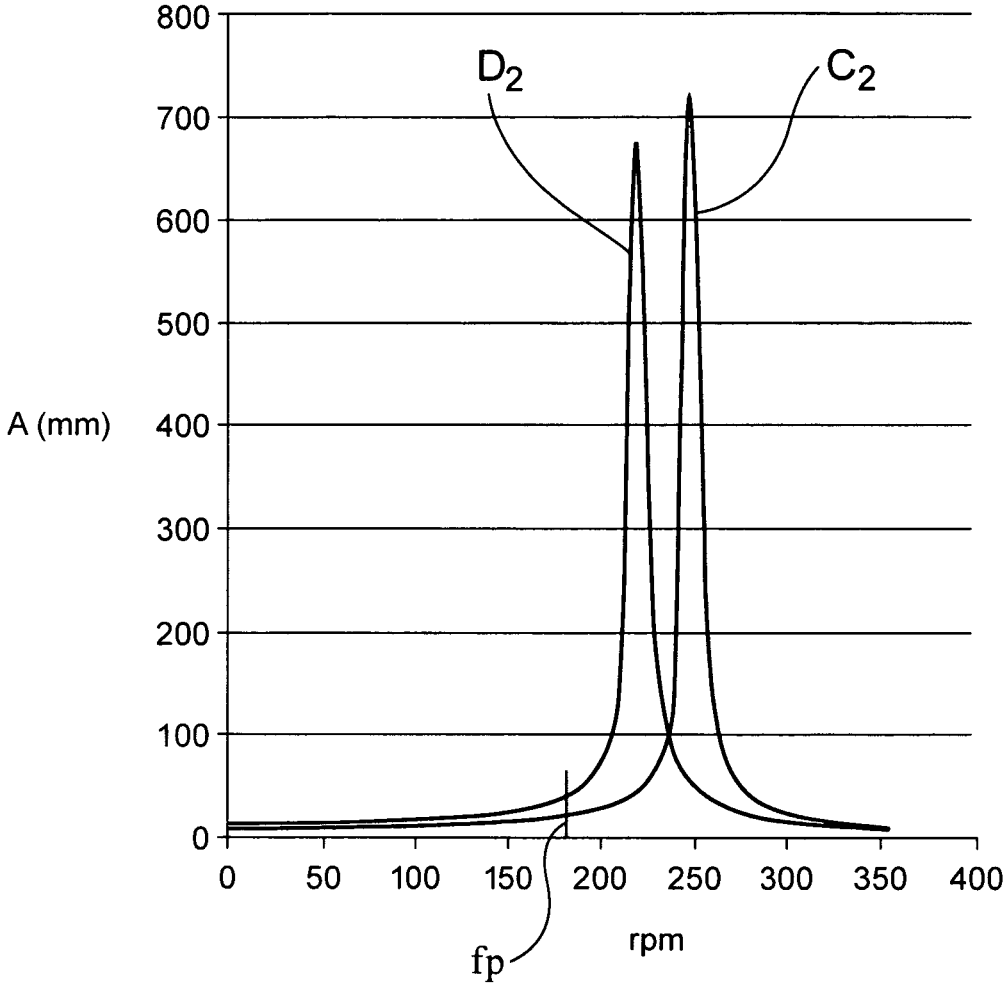
FIG. 4 shows the curve of vibration amplitudes in the cage walls as a function of the structure stressing frequency.

The curve D2 of FIG. 4, associated with a traditional cage with no indent, and the curve C2 associated with a similar structure having increased stiffness, show that the resonance frequency of the cage increases with structure stiffness.

In such type of structures, the resonance frequency reaches values of more than 220 rpm, i.e. higher than the vibration test values required by the standards (about 180-190 rpm).

Therefore, considering a test frequency "fp" of 180 rpm, it can be noted from FIG. 4 that the cage wall vibration amplitude is reduced from the curve D2, associated with the cage without indents to the curve C2, associated with the cage with increased rigidity.

This reduced oscillation amplitude in the cage wall 13 reduces the influence of the notch effect at the welded joints between the bars 19, 21, thereby allowing the cage to exhibit satisfactory resistance during the vibration tests.

In addition to a reduced side wall oscillation amplitude, the tests also showed, an increased wall oscillation frequency with respect to the test frequency. This can be explained in that, with the same amount of energy supplied to the structure, such energy is dissipated with more frequent vibrations of lower amplitude.

A square or rectangular section is particularly preferred for the cage bars, as it can ensure a high modulus of inertia and add stiffness to the cage structure.

Preferably, the distance "a" of the indents 22 from the intersections 20 is from once to twice the width "b" of the bar. The width "b" of the bars 19, 21 is of 15 mm to 20 mm.

The particular range of values for the quantity "a" covering once to twice the width "b" of the bar is particularly advantageous for satisfactory stiffening of the cage structure. In fact, if the distance "a" is excessively increased, the cage stiffening will decrease, as the two indents 22 between two successive intersections will be too close to each other and thus simulate a structure with a single indent between two successive intersections.

The indents 22 will preferably be from 3 mm to 7 mm deep. In the embodiment of the figures, the indents 22 have an axis transverse to the extension of the bar 19 and are open at the sides of the bar.

Preferably, the indents 22 have a length in a longitudinal direction of the bar from 0.3 times to twice the width "b" of the bar. Furthermore, in a preferred embodiment, the indents 22 are generally shaped like a circular arc, when viewed along a longitudinal plane of the bar. Preferably, the ratio of the length to the depth of the indents 22 is of 0.8 to 1.3.

Preferably, the bars 19, 21 have cavities 25 at their respective intersection areas with other bars. Preferably both bars 19, 21 for each intersection have a cavity 25.

As used herein, the term "intersection area" is intended to designate the area of the wall of the bar 19, 21 which opposes the wall of another bar 19, 21 at a corresponding intersection.

According to a particularly preferred embodiment of the invention, the welded bars 19, 21 are substantially in contact with each other over the whole intersection area.

This ensures firmer fixation of the two bars, with cavities 25 of equal depth, and the ability to withstand the various mechanical stresses to which the cage may be subjected in operation and during the tests.

Particularly, by combining this welding arrangement with the presence of indents 22 at the distance as provided by the invention, the cage structure 13 was found to exhibit a satisfactory behavior during the vibration test.

Preferably, the cavities 25 on the bars are formed on a flat lateral face 24 of the bar. In a particularly advantageous embodiment, the cavities 25 have substantially flat bottom walls 26, 27, which contact each other as the bars are welded together.

The edges of the cavities 25 are substantially flush with the surface of the bar wall 24, and fully encircle the bottom walls 26, 26 in both longitudinal and transverse directions of the bar.

Advantageously, during manufacture of the cage, the bars 19, 21 are welded while being pressed against each other, so that the side walls of the bars 19, 21 are moved to mutual contact in all respective intersection areas.

In a particularly preferred embodiment, the cavities 25 have a depth of 2.5 mm or more. Particularly, the cavity 25 of a bar 19 has a maximum depth at the grooves 29 formed during welding by the ribs 28 of the other bar 21.

The ribs 28 are the side edges of the cavity of the bar 21 and are located on opposite longitudinal sides of the bar 21 (see FIG. 2). Such conformation of the bars in the intersection area is disclosed in patent EP0755863.

This particular configuration of the intersection area of the bars, in combination with the position of the indents 22, is of further help in providing a structure that can satisfactorily withstand the vibration tests.

Preferably, the cavities 25 in the bars at the intersection area have a maximum depth of less than 5 mm.

The cavities 25 might also be present on one of the bars for each intersection.

In the preferred embodiment as shown in the figures, the indents 22 are only formed on the vertical bars 19.

The vertical bar 19 only has indents 22 on the face 24 that has the welding joints with the horizontal bars 21. The face 23 facing towards the face 24 is formed with no cavity and is preferably flat. This configuration was found to have an optimized resistance to vibration during the tests.

The walls of the tubular bars 19, 21 have a thickness from 0.7 mm to 1.2 mm.

Preferably, each vertical bar 19 has indents 22. Particularly, each bar 19 has two indents 22 at each intersection 20 with a bar 21, on opposite sides of the intersection 20.

Preferably, the cavities 25 in the bars extend longitudinally over a length that is larger than the width of the bar, thereby projecting on each side of the intersection 20.

Preferably, the bar has at least one portion without cavities between the intersection and the indents 22. More preferably, the bar has a portion with substantially the maximum section between the intersection area and the indent 22.

This clearly shows that the objects of the present invention have been fulfilled.

A pallet container structure is thus obtained, that can satisfactorily withstand the vibration tests imposed by the standards.

Particularly, the container cage exhibits a satisfactory resistance at the welded joints between vertical and horizontal bars.

The cage structure has an increased stiffness, unlike the prior art disclosed in EP 1 289 852, that was aimed at increasing the flexibility of the structure to maintain the cage integrity at the welded joints.

During the vibration tests, the oscillation amplitude at the side walls of the container is reduced, and this involves a reduced influence of the notch effect originated by the welded joints between the cage bars.

Those skilled in the art will obviously appreciate that a number of changes and variants may be made to the arrangements as described hereinbefore to meet incidental and specific needs, without departure from the scope of the invention, as defined in the following claims.

For instance, according to a variant embodiment, indents identical to the indents 22 might be formed on the horizontal bars 21 of the cage, in addition to or instead of the indents on the vertical bars 19. Also, the indents 22 might also or alternatively be formed on the face 23 of the vertical bars 19.

The invention claimed is:

1. A pallet container for storage and transportation of liquids, comprising an inner liquid container, a cage that encloses the inner container and a pallet with said cage mounted thereto, the cage comprising a plurality of vertical and horizontal tubular bars connected together by welded joints formed at respective intersections between the bars, a plurality of said bars comprising one or more indents at a distance (a) from the intersections that is equal to or longer than the width (b) of the bars, wherein two indents are formed between two successive intersections so that two indents are formed for each bar intersection, on the same bar and on opposite sides of the intersection.

2. A pallet container as claimed in claim 1, wherein the indents are at a distance (a) from said intersections that is less than twice the width (b) of the bars.

3. A pallet container as claimed in claim 1, wherein the width (b) of the bars is of 15 mm to 20 mm.

4. A pallet container as claimed in claim 1, wherein the indents are only formed on the vertical bars.

5. A pallet container as claimed in claim 1, wherein the indents are 3 mm to 8 mm deep.

6. A pallet container as claimed in claim 1, wherein said bars have a cavity at an area of intersection with another bar.

7. A pallet container as claimed in claim 6, wherein said cavities have a depth of 2.5 mm or more.

8. A pallet container as claimed in claim 1, wherein the bars substantially contact each other all over the opposed bar walls at an intersection.

9. A pallet container as claimed in claim 1, characterized in that said bars have a substantially rectangular or square cross section.

10. A pallet container as claimed in claim 1, wherein said bars are welded together at their mutually facing side faces.

11. A pallet container as claimed in claim 1, wherein, at the intersection area, two welded bars have respective cavities with substantially flat bottom portions, said bottom portions of the two bars substantially contacting each other.

12. A pallet container as claimed in claim 1, wherein the length of the indents in the longitudinal direction of the bars is 0.3 times to twice the width of the bar.

13. A pallet container as claimed in claim 1, wherein the thickness of the tubular wall of the bars is of 0.7 mm to 1.2 mm.

14. A pallet container for storage and transportation of liquids, comprising an inner liquid container, a cage that encloses the inner container and pallet with said cage mounted thereto, the cage comprising a plurality of vertical and horizontal tubular bars connected together by welded joints formed at respective intersections between the bars, a plurality of said bars comprising one or more indents at a distance (a) from the intersections that is equal to or longer than the width (b) of the bars wherein two indents are formed between two successive intersections so that two indents are formed for each bar intersection, on the same bar and on opposite sides of the intersection and wherein the indents are only formed on the side of the bars in which the welded joints are formed.

* * * * *

UNITED STATES PATENT AND TRADEMARK OFFICE

CERTIFICATE OF CORRECTION

PATENT NO. : 8,424,702 B2
APPLICATION NO. : 12/862016
DATED : April 23, 2013
INVENTOR(S) : Cassina It is certified that error appears in the above-identified patent and that said Letters Patent is hereby corrected as shown below:

On the title page, item [73] should read

-- (73) Assignee: Greif International Holding B.V., AK Vreeland, Netherlands --.

Signed and Sealed this
Seventh Day of January, 2014

Margaret A. Focarino

Margaret A. Focarino
*Commissioner for Patents of the United States Patent and Trademark Office*